United States Patent [19]

Klimezky

[11] 4,279,681

[45] Jul. 21, 1981

[54] MOLDED BASEBALL GLOVE AND THE METHOD OF MAKING

[76] Inventor: Frank Klimezky, 3581 S. Ocean Blvd., South Palm Beach, Fla. 33460

[21] Appl. No.: 105,139

[22] Filed: Dec. 19, 1979

Related U.S. Application Data

[63] Continuation-in-part of Ser. No. 879,124, Feb. 21, 1978, abandoned.

[51] Int. Cl.[3] ..... B29C 19/00; B32B 7/14; B29C 13/00; A41D 13/08

[52] U.S. Cl. ..... 156/245; 264/302; 264/294; 2/19

[58] Field of Search ..... 156/251, 291, 245; 264/302, 294; 2/19

[56] References Cited

U.S. PATENT DOCUMENTS

| | | | |
|---|---|---|---|
| 2,261,583 | 11/1941 | Hemphill | 156/245 |
| 2,810,161 | 10/1957 | Milton | 264/302 |
| 3,300,787 | 1/1967 | Denkert | 2/19 |

*Primary Examiner*—David A. Simmons
*Assistant Examiner*—Louis Falasco
*Attorney, Agent, or Firm*—Barry L. Haley

[57] ABSTRACT

An integrally molded plastic baseball glove utilizable in the game of baseball as a catching device for protecting the hand. The final molded article has the aesthetic appearance of a leather baseball glove. The method of making includes first molding a hollow plastic shell which forms exterior convex front and back surfaces of the baseball glove, the shell front and back surface having exterior, shaped-segments including patterned depressions and protuberances which form outlines delineating the fingers and thumb areas of the glove, a pair of webs between the thumb and index finger areas, an additional surface including cut out lines and lacing to make it look like a leather glove. The shell may be molded utilizing slush, rotation or blow-injection techniques. The mold face itself that forms the front glove shell exterior surface is not an exact replica of the final glove form but is distorted in surface configuration such that the front exterior surface when molded is convex overall. When the glove is finally constructed, the front exterior surface is substantially concave, with convex tubular finger and thumb areas. After removal of the shell from the mold, the convex front glove surface is forced inwardly so that the front and back shell areas delineating the fingers and thumb can be joined together. A suitable padding may be inserted (or molded) in the inside palm area of the glove. The webbing is trimmed and perforated and cut outs made where required. A pocket for receiving the ball when inverted from its convex molded shape will be formed from cold setting of the plastic after removal from the mold.

4 Claims, 5 Drawing Figures

MOLDED BASEBALL GLOVE AND THE METHOD OF MAKING

This is a continuation-in-part of U.S. Ser. No. 879,124, filed Feb. 21, 1978, now abandoned entitled Molded Baseball Glove and the Method of Making.

BACKGROUND OF THE INVENTION

This invention relates to a baseball glove and a method of making the same such that a unitarily formed, molded plastic glove may be achieved.

In the past, conventional baseball gloves have been constructed of leather, traditionally employing hand-stitching, a web portion that was usually fastened by rawhide between the thumb and index finger of the glove, independent finger sockets joined by rawhide lacing, and often with surface padding inserts. Leather gloves have become extremely expensive because of both manufacturing and material costs. The present invention provides a glove made of plastic which is unitarily formed in a molding process, greatly reducing the cost of manufacture while still not detracting from the overall utility or appearance of a leather glove.

Using conventional molding techniques and especially slush molding for example, it is physically impossible to mold directly an article that has the identical form and shape of a conventional leather baseball glove. This is because when molding such a product the spacing between the fingers, the pocket areas in the central interior portion, the webbing between the index finger and thumb, and the overall shape, would require a mold that would not allow the finished molded article to be physically removed from the mold. Thus, using a conventional slush mold, it is obvious that such a molding technique cannot be employed for making an identical baseball glove. Applicant, however, has discovered a way that such a replica of a leather baseball glove can be reproduced using a slush mold technique. This is achieved by first molding a uniquely shaped integrally formed plastic shell which in its original molded form is distorted in shape in preselected areas relative to a finished, completed baseball glove such that the shell after removal from the mold, can be joined along particular seams using joining techniques between fingers and fore finger and thumb to achieve a finished glove having the appearance of a leather glove.

The present invention may be molded in a slush or rotational mold which integrally forms the overall resilient shell of the glove, the shell having a surface design, front and back to ultimately assimilate a leather glove in appearance. After molding and removal, the front and back surfaces of the resilient shell are then glued or welded in the appropriate areas to form the individual fingers and thumb in the glove, the pocket in the front face, and the web.

BRIEF DESCRIPTION OF THE INVENTION

A baseball glove comprising a unitarily molded resilient plastic shell, said shell having an exterior that includes convex front and back surfaces having appropriate depressions and protuberances forming patterns including front and back, half finger and thumb delineations, a front and back web between the thumb and index fingers and suitable padding molded on the inside of the shell or affixed thereto by other means. The molded front and rear exterior surfaces of the plastic shell are not exact duplicates of a finished glove but are distorted such that the front exterior surface of the shell, when molded, is convex overall. When the shell front and rear surfaces are finally joined together between the fingers and fore-finger and thumb areas, the front exterior surface of the shell becomes substantially concave with convex tubular finger and thumb areas which are readily joined to the back surface of the shell which has corresponding thumb and finger areas. The distorted exterior front surface forming the front of the glove (where the ball pocket is located) is distorted in such a way that the shell itself after forming in a slush mold can be removed through the access opening in the mold. The front surface of the molded shell is formed and sized to fit an engaged back surface (forming the back of the glove) such that when joined the two surfaces provide an article that aesthetically appears as a leather baseball glove. The thumb and finger areas on the front and back surfaces form half thumb and fingers, such that when the front surface is welded or glued to the rear surface along the appropriate thumb and finger delineations, fully enclosed, separate thumb and finger receiving areas are formed. A ball-receiving pocket is formed in the front surface from cold setting of the plastic after removal from the mold.

For forming the glove using the slush molding technique, a plastic (liquid or powder) is poured into a preformed mold shaped as the shell described above. The mold is then heated, causing the plastic abutting the mold to solidify along the inside interface of the mold. Once a sufficient thickness of plastic shell has been solidified, the remaining plastic is dumped from the mold. The mold is heated again until the shell has cured and then allowed to cool further, after which the resilient shell is physically removed from the mold. The convex front surface of the shell is depressed inwardly forcing the front surface towards the rear surface of the shell.

An area in the back surface may be cut out, leaving a strip or finger opening near the shell opening. The strip has the appearance of a strap. A suitable padding may be added or may be molded into the glove in appropriate locations for protection of the hand. The shell front and back surfaces are then welded (or glued) along the fingers, thumb, and web delineations to form the glove.

It is an object of this invention to provide a molded baseball glove of reduced construction costs.

It is another object of this invention to provide a plastic baseball glove that has the appearance of a conventional leather glove which is constructed using molding techniques into a unitary piece.

And yet, another object of this invention is to provide a molded baseball glove and the method of making the same.

In accordance with these and other objects which will be apparent hereinafter, the instant invention will now be described with particular reference to the accompanying drawings.

PREFERRED EMBODIMENT OF THE INVENTION

Figure 1:
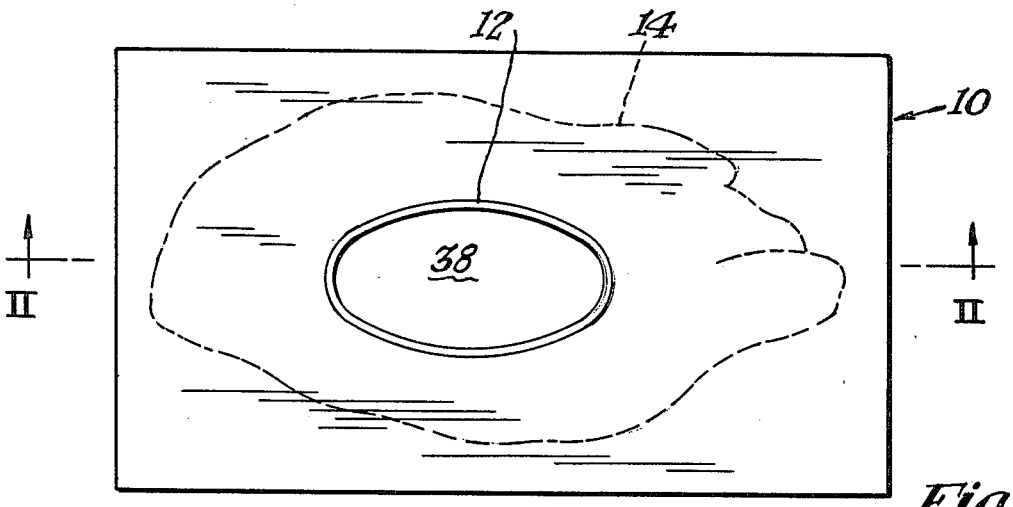
FIG. 1 is a top plan view of a mold utilized in the construction of the instant invention.
Figure 2:
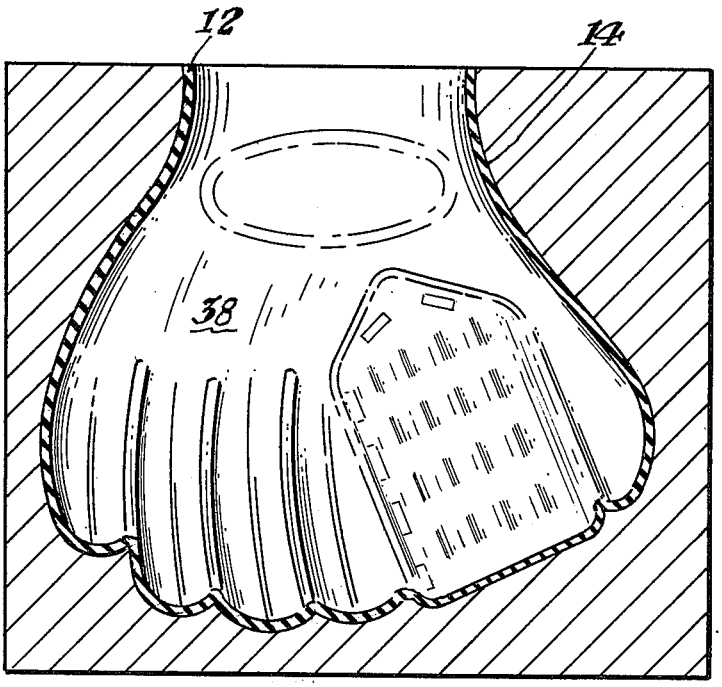
FIG. 2 is a side elevational view in cross-section of the mold shown in FIG. 1.
Figure 3:
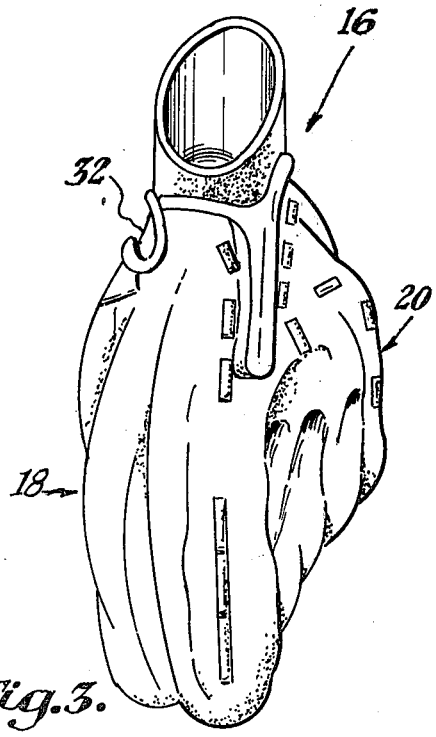
FIG. 3 is a shell showing the instant invention prior to final fabrication.

Referring now to the drawings and specifically FIG. 1, a cavity mold is shown at 10 that is utilized in the fabrication of the instant invention. Mold 10 includes an upper opening 12 into cavity 38 which includes the inner mold face 14, which is in the shape of a glove shell. FIG. 2 shows the cavity 38 in which the face of the cavity 14 is shaped to form the back surface of the glove. The actual mold face 14 is distorted in shape when compared with the surface of a conventional glove. Delineations are provided for distinguishing and forming the finger areas, the thumb areas and the web portions on the front and back surfaces. Note that the outline 14 shown in FIG. 1 of the shell cavity is clearly not the outline of a finished conventional glove but, as shown in FIG. 3, depicts the outline of the cavity in the mold such that the front face 20 of the molded shell is extremely distorted as compared with a finished glove. The mold surface 14 includes protuberances and indentations for forming half-finger and half-thumb areas and the flat web areas on both sides (front and back) such that when the shell in FIG. 3 is forced inwardly from the forward face, the front surface mates with the rear surface for joining by welding or glueing along the finger delineations, thumb delineations, and the webs.

Figure 5:
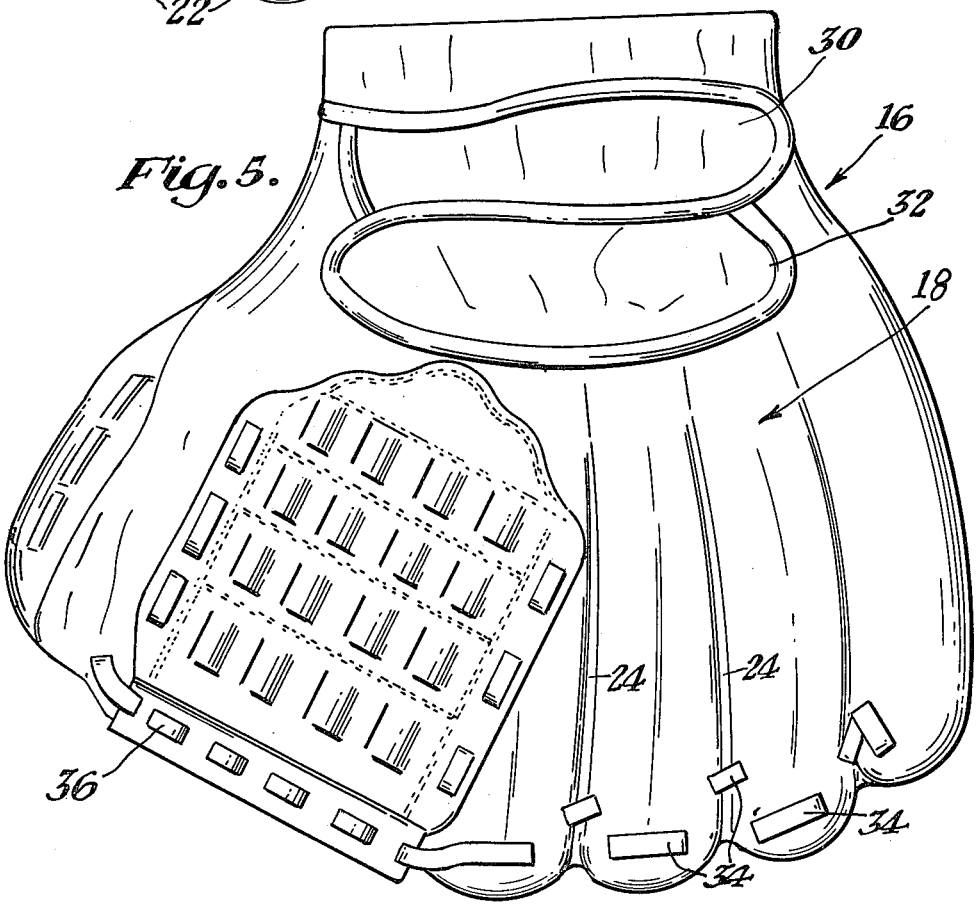
FIG. 5 shows a back elevational view of the instant invention.

FIGS. 3 and 5 show a molded glove shell 16 which has a front surface 20 and a rear surface 18 that includes an area 32 which is to be cut out leaving strap-like portion 30 or a finger opening. The glove shell shown in FIG. 3 is how the shell appears after it has been removed from mold 10 prior to the final fabrication of the glove.

Figure 4:
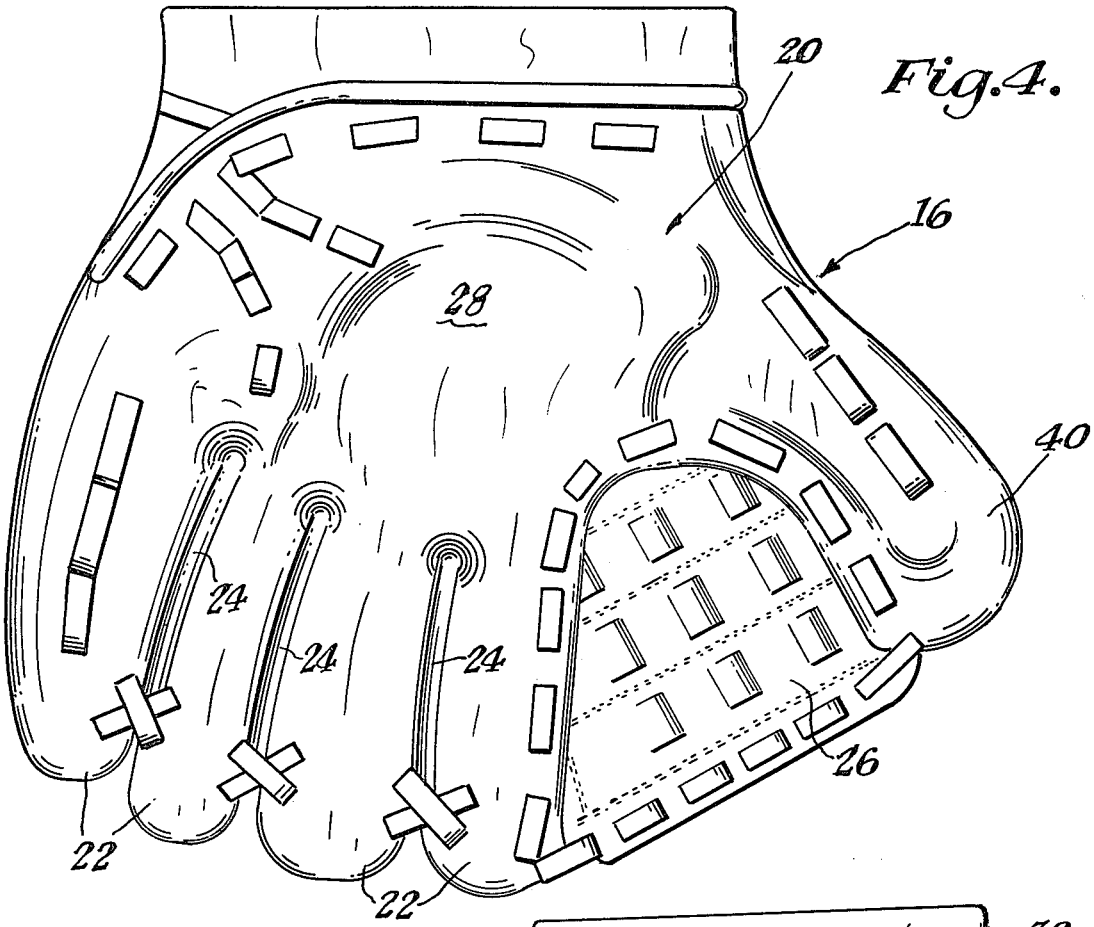
FIG. 4 shows a front elevational view of the instant invention.

FIG. 4 shows the front surface of a finally fabricated glove in which the finger delineations 24 have been welded or glued between the front and back surfaces of the glove to form complete finger receiving areas. Also, the thumb halves 40 have been welded along their inner edges and webs 26 are welded together between the front and back surfaces to form a glove web. A ball-receiving pocket is also formed in the glove, shown as area 28, which is achieved during molding by convex distortion in the shape of the mold surface.

FIGS. 4 and 5 show the front and back surfaces of the glove after fabrication which includes an integrally formed strap 30, the visual effect being achieved by cutting out area 32 and trimming along protrusion 42. The surfaces 18 and 20 include additional ornate areas 34 and 36 which simulate leather lacing found in leather gloves. Also, the web includes decorative areas, again giving it the ornate appearance of a real leather glove.

In the formation of the molded shell, the mold shown in FIG. 1 would be filled with a liquid or powdered plastic and heated. The heating of the plastic material along the surface 14 of the mold cavity will cause a layer to solidify due to the heating effect. Once a layer of material of a particular thickness has jelled sufficiently, the remaining liquid or powder is dumped so that the plastic remaining is evacuated, leaving a plastic shell along the face of the mold. The mold is then heated to cure the shell. Once the molding process is completed, the resilient shell is then pulled from the mold. The removed shell (as shown in FIG. 3) is then ready for final fabrication which includes the welding or glueing between the fingers, between the fore finger and thumb, and web areas, cutting out of the area on the back surface just above the strap area, and final trimming at 42.

As shown in FIGS. 4 and 5, after final fabrication, the glove has the appearance of a leather glove while in fact being constructed in a unitary single piece.

Additional padding can be formed integrally by molding foam where required, or by inserting and attaching pads to the inside surface of the shell.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. The method of making a unitary plastic baseball glove having the appearance of a conventional leather baseball glove comprising:
   (a) forming in a cavity mold a plastic unitary hollow shell, said molded shell having a outer convex front surface being distorted in shape when molded compared to said front surface of said conventional baseball glove, said front and rear surfaces including predetermined protuberances and indentations forming half-finger receiving areas, half-thumb receiving areas and a web surfaces extending between the thumb and index half-finger areas;
   (b) removing the shell from the mold cavity;
   (c) forcing the distorted convex front surface of the shell inwardly concavely for contiguous positioning of the half-finger delineations the half-thumb delineations, and the web areas between the front and rear surfaces, said front surface having the appearance of the front surface of a conventional baseball glove in the collapsed, concave position when contiguous with the rear surface of said shell; and
   (d) connecting the half-finger delineating areas, half-thumb delineating areas, and the webs together to form a final molded conventionally appearing baseball glove.

2. The method as in claim 1, wherein step (a) further includes molding said shell front and rear surfaces with additional protuberances and indentations in predetermined areas providing the outer surfaces front and rear of said shell with the appearance of strips, seams, lacing, and stitching found on a conventional leather baseball glove.

3. The method as in claim 1, including the steps of:
   (e) molding a strap-like area and a delineated area for removal on the outer rear surface of said shell; and
   (f) removing the delineated area from said shell.

4. A plastic, unitary baseball glove formed from the method of claim 1.

* * * * *